US011145252B2

(12) United States Patent
Hung et al.

(10) Patent No.: US 11,145,252 B2
(45) Date of Patent: Oct. 12, 2021

(54) LIGHT-EMITTING DIODE APPARATUS AND CONTROL METHOD THEREOF

(71) Applicant: Au Optronics Corporation, Hsinchu (TW)

(72) Inventors: Sen-Chuan Hung, New Taipei (TW); Shih-Hao Kuo, Pingtung County (TW)

(73) Assignee: Au Optronics Corporation, Hsinchu (TW)

( * ) Notice: Subject to any disclaimer, the term of this patent is extended or adjusted under 35 U.S.C. 154(b) by 144 days.

(21) Appl. No.: 16/423,028

(22) Filed: May 26, 2019

(65) Prior Publication Data

US 2019/0378460 A1 Dec. 12, 2019

(30) Foreign Application Priority Data

Jun. 8, 2018 (TW) ..... 107119932

(51) Int. Cl.

| | |
|---|---|
| ***G09G 3/3233*** | (2016.01) |
| ***G09G 3/3258*** | (2016.01) |
| ***G09G 3/3225*** | (2016.01) |
| ***G09G 3/325*** | (2016.01) |
| ***G09G 3/3208*** | (2016.01) |
| *G09G 3/32* | (2016.01) |

(52) U.S. Cl.

CPC ..... *G09G 3/3233* (2013.01); *G09G 3/325* (2013.01); *G09G 3/3208* (2013.01); *G09G 3/3225* (2013.01); *G09G 3/3258* (2013.01); *G09G 3/32* (2013.01); *G09G 2300/043* (2013.01); *G09G 2300/0842* (2013.01); *G09G 2300/0861* (2013.01); *G09G 2320/0261* (2013.01)

(58) Field of Classification Search

CPC .... G09G 3/3208; G09G 3/3225; G09G 3/325; G09G 3/3258; G09G 3/3233; G09G 3/32; G09G 3/3255; G09G 2320/0261; G09G 2300/043; G09G 2300/0842; G09G 2300/0861

USPC ..... 345/691, 76, 77

See application file for complete search history.

(56) References Cited

U.S. PATENT DOCUMENTS

| | | | |
|---|---|---|---|
| 8,085,225 | B2 | 12/2011 | Kohno et al. |
| 8,497,856 | B2 | 7/2013 | Ota |
| 9,224,357 | B2 | 12/2015 | Kim et al. |

(Continued)

FOREIGN PATENT DOCUMENTS

| | | |
|---|---|---|
| CN | 102163398 | 8/2011 |
| CN | 103578415 | 2/2014 |

(Continued)

*Primary Examiner* — Jason M Mandeville
(74) *Attorney, Agent, or Firm* — JCIPRNET

(57) ABSTRACT

A light-emitting diode apparatus and a control method of the light-emitting diode apparatus are provided. The control method includes: applying a pre-reset voltage to a control terminal of a driving transistor of the light-emitting diode apparatus in a pre-resetting stage to pre-reset the control terminal of the driving transistor; resetting the control terminal of the driving transistor of the light-emitting diode apparatus by using a reset voltage source in a first resetting stage; compensating the control terminal of the driving transistor to a compensation voltage in a compensation stage; and providing, by the driving transistor, a driving current in a light emission stage to drive a light-emitting diode of the light-emitting diode apparatus to emit light.

18 Claims, 13 Drawing Sheets

(56) References Cited

U.S. PATENT DOCUMENTS

| | | | | |
|---|---|---|---|---|
| 9,478,164 | B2 | 10/2016 | Ma | |
| 9,965,097 | B2 * | 5/2018 | Yang | G09G 3/3266 |
| 10,297,195 | B2 * | 5/2019 | Feng | G09G 3/3233 |
| 2011/0205220 | A1 | 8/2011 | Ota | |
| 2014/0028859 | A1 | 1/2014 | Kim et al. | |
| 2015/0348462 | A1 | 12/2015 | Ma | |
| 2018/0047337 | A1 * | 2/2018 | Zhu | G09G 3/3233 |
| 2018/0190177 | A1 | 7/2018 | Hung et al. | |
| 2018/0315374 | A1 * | 11/2018 | Zhang | G09G 3/3258 |
| 2019/0237019 | A1 * | 8/2019 | Gao | G09G 3/3233 |

FOREIGN PATENT DOCUMENTS

| | | |
|---|---|---|
| CN | 103985352 | 8/2014 |
| CN | 105741754 | 7/2016 |
| TW | 201724070 | 7/2017 |

* cited by examiner

LIGHT-EMITTING DIODE APPARATUS AND CONTROL METHOD THEREOF

CROSS-REFERENCE TO RELATED APPLICATION

This application claims the priority benefit of Taiwan application serial no. 107119932, filed on Jun. 8, 2018. The entirety of the above-mentioned patent application is hereby incorporated by reference herein and made a part of this specification.

BACKGROUND OF THE INVENTION

Field of the Invention

The disclosure relates to a light-emitting diode apparatus and a control method of the light-emitting diode apparatus.

Description of Related Art

As display technologies advance, the light-emitting diode has been applied to various display techniques, and the active-matrix organic light-emitting diode (AMOLED) is one of the main areas of development for the display techniques.

SUMMARY OF THE INVENTION

When the AMOLED is operated at a high speed, motion blur may be generated in the display.

The invention provides a light-emitting diode apparatus and a control method of the light-emitting diode apparatus that can improve the motion blur.

The control method of the light-emitting diode apparatus of the invention includes the following steps. A pre-reset voltage is applied to a control terminal of a driving transistor of the light-emitting diode apparatus in a pre-resetting stage to pre-reset the control terminal of the driving transistor, wherein the pre-reset voltage increases a voltage difference between the control terminal and a first terminal of the driving transistor. The control terminal of the driving transistor of the light-emitting diode apparatus is reset by using a reset voltage source in a first resetting stage. The control terminal of the driving transistor is compensated to a compensation voltage in a compensation stage. The driving transistor provides a driving current in a light emission stage to drive a light-emitting diode of the light-emitting diode apparatus to emit light.

In an embodiment of the invention, the pre-reset voltage is a voltage of a data signal coupled to the control terminal of the driving transistor through at least one capacitor.

In an embodiment of the invention, the control method further includes the following step. The first terminal of the driving transistor is reset to a target voltage in a second resetting stage to increase a voltage difference between the first terminal and a second terminal of the driving transistor, wherein the first terminal of the driving transistor is coupled to the light-emitting diode.

In an embodiment of the invention, a start time point of the light emission stage is between a start time point and an end time point of the second resetting stage.

In an embodiment of the invention, a second terminal of the driving transistor is coupled to a high voltage source, and the light-emitting diode apparatus further includes a first switch, a second switch, a third switch, a fourth switch, a fifth switch, a sixth switch, and a charge storage device. A first terminal and a second terminal of the first switch are respectively coupled to a reference voltage source and a first terminal of the second switch. A second terminal of the second switch is configured to receive a data signal. The charge storage device is coupled between the first terminal of the second switch and the control terminal of the driving transistor. The third switch and the fourth switch are connected in series between the control terminal and the second terminal of the driving transistor. The fifth switch is coupled between a common contact of the third switch and the fourth switch and the reset voltage source. A first terminal and a second terminal of the sixth switch are respectively coupled to the first terminal of the driving transistor and an anode of the light-emitting diode. A cathode of the light-emitting diode is coupled to a low voltage source. On/off states of the first switch and the sixth switch are controlled by a light emission control signal. An on/off state of the fifth switch is controlled by a first control signal. On/off states of the second switch to the fourth switch are controlled by a second control signal. The control method of the light-emitting diode apparatus includes the following steps. In the pre-resetting stage, the switches controlled by the second control signal are turned on, and the switches controlled by the light emission control signal and the first control signal are turned off. In the first resetting stage, the switches controlled by the first control signal and the second control signal are turned on, and the switches controlled by the light emission control signal are turned off. In the compensation stage, the switches controlled by the second control signal are turned on, and the switches controlled by the light emission control signal and the first control signal are turned off. In the light emission stage, the switches controlled by the light emission control signal are turned on, and the switches controlled by the first control signal and the second control signal are turned off.

In an embodiment of the invention, in the control method, the second terminal of the sixth switch is reset to a target voltage in a second resetting stage to increase a voltage difference between the first terminal and the second terminal of the driving transistor.

In an embodiment of the invention, a start time point of the light emission stage is between a start time point and an end time point of the second resetting stage.

In an embodiment of the invention, the control method includes the following step. The first control signal is delayed to generate a reset signal in the second resetting stage to reset the second terminal of the sixth switch to the target voltage.

In an embodiment of the invention, the first switch to the sixth switch respectively include a transistor.

In an embodiment of the invention, the compensation voltage is a difference value between a voltage level of the high voltage source and a threshold voltage of the driving transistor.

In an embodiment of the invention, the light-emitting diode includes an organic light-emitting diode.

The light-emitting diode apparatus of the invention includes a driving transistor and a light-emitting diode. An anode and a cathode of the light-emitting diode are respectively coupled to a first terminal of the driving transistor and a low voltage source. A second terminal of the driving transistor is coupled to a high voltage source. A control terminal of the driving transistor receives a pre-reset voltage in a pre-resetting stage to be pre-reset. The control terminal of the driving transistor receives a reset voltage in a first resetting stage to be reset. The control terminal of the driving transistor is compensated to a compensation voltage in a compensation stage. The driving transistor provides a driving current in a light emission stage to drive the light-emitting diode to emit light. The pre-reset voltage increases a voltage difference between the control terminal and the first terminal of the driving transistor.

In an embodiment of the invention, the pre-reset voltage is a voltage of a data signal coupled to the control terminal of the driving transistor through at least one capacitor.

In an embodiment of the invention, the first terminal of the driving transistor is reset to a target voltage in a second resetting stage to increase a voltage difference between the first terminal and the second terminal of the driving transistor.

In an embodiment of the invention, a start time point of the light emission stage is between a start time point and an end time point of the second resetting stage.

In an embodiment of the invention, the light-emitting diode apparatus includes a first switch, a second switch, a third switch, a fourth switch, a fifth switch, a sixth switch, and a charge storage device. A first terminal and a second terminal of the first switch are respectively coupled to a reference voltage source and a first terminal of the second switch. A second terminal of the second switch is configured to receive a data signal. The third switch and the fourth switch are connected in series between the control terminal and the second terminal of the driving transistor. The fifth switch is coupled between a common contact of the third switch and the fourth switch and a reset voltage source. A first terminal and a second terminal of the sixth switch are respectively coupled to the first terminal of the driving transistor and the anode of the light-emitting diode. The charge storage device is coupled between the first terminal of the second switch and the control terminal of the driving transistor. On/off states of the first switch and the sixth switch are controlled by a light emission control signal. An on/off state of the fifth switch is controlled by a first control signal. On/off states of the second switch to the fourth switch are controlled by a second control signal. In the pre-resetting stage, the switches controlled by the second control signal are turned on, and the switches controlled by the light emission control signal and the first control signal are turned off. In the first resetting stage, the switches controlled by the first control signal and the second control signal are turned on, and the switches controlled by the light emission control signal are turned off. In the compensation stage, the switches controlled by the second control signal are turned on, and the switches controlled by the light emission control signal and the first control signal are turned off. In the light emission stage, the switches controlled by the light emission control signal are turned on, and the switches controlled by the first control signal and the second control signal are turned off.

In an embodiment of the invention, the second terminal of the sixth switch is reset to a target voltage in a second resetting stage to increase a voltage difference between the first terminal and the second terminal of the driving transistor.

In an embodiment of the invention, a start time point of the light emission stage is between a start time point and an end time point of the second resetting stage.

In an embodiment of the invention, the light-emitting diode apparatus includes a delay circuit. The delay circuit is coupled to the second terminal of the sixth switch and delays the first control signal to generate a reset signal in the second resetting stage to reset the second terminal of the sixth switch to the target voltage.

In an embodiment of the invention, the first switch to the sixth switch respectively include a transistor.

In an embodiment of the invention, the compensation voltage is a difference value between a voltage level of the high voltage source and a threshold voltage of the driving transistor.

In an embodiment of the invention, the light-emitting diode includes an organic light-emitting diode.

In light of the above, in the light-emitting diode apparatus of the invention, the control terminal of the driving transistor is pre-reset in the pre-resetting stage, the control terminal of the driving transistor is reset by using the reset voltage source in the first resetting stage, and the control terminal of the driving transistor is compensated to the compensation voltage in the compensation stage. Accordingly, by pulling down the voltage of the control terminal of the driving transistor in the pre-resetting stage and the first resetting stage, the voltage difference between the source and the gate of the driving transistor can be effectively increased to offset the coupling effect in the circuit, and motion blur of the light-emitting diode apparatus can be reduced.

To provide a further understanding of the aforementioned and other features and advantages of the disclosure, exemplary embodiments, together with the reference drawings, are described in detail below.

DESCRIPTION OF THE EMBODIMENTS

Figure 1:
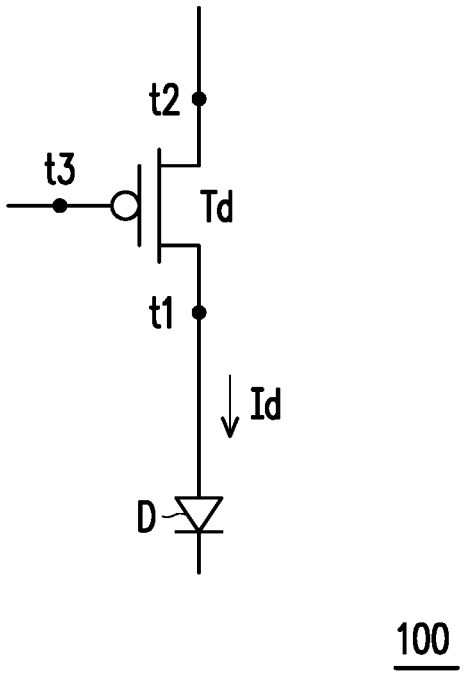
FIG. 1 is a schematic diagram illustrating coupling between a light-emitting diode and a driving transistor according to an embodiment of the invention.
Figure 2:
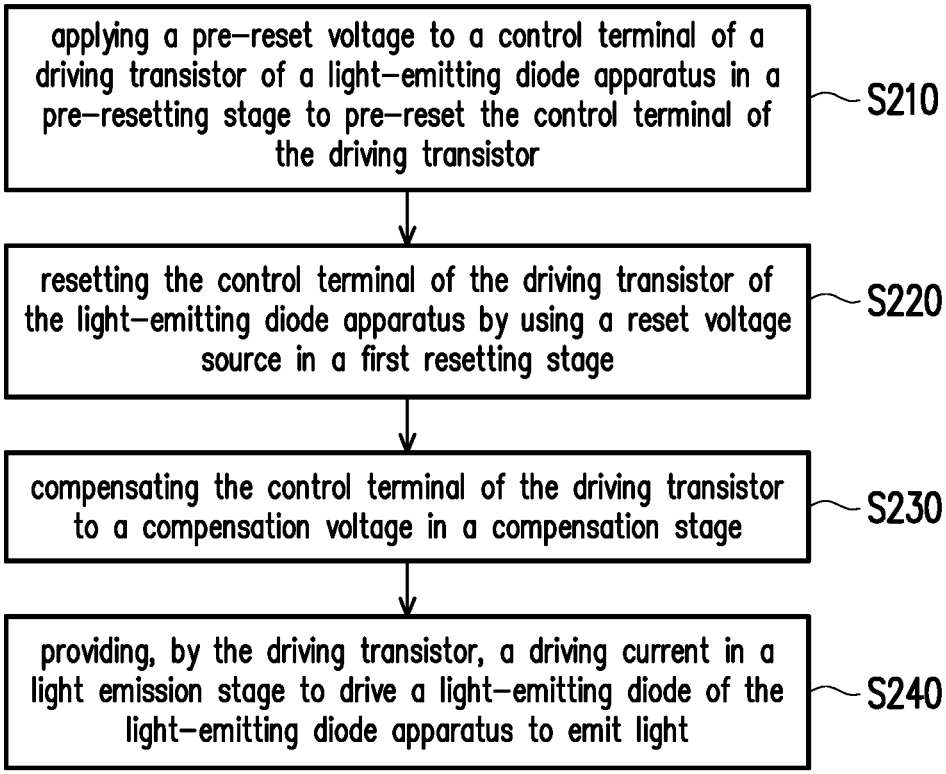
FIG. 2 is a flowchart illustrating a control method of a light-emitting diode apparatus according to an embodiment of the invention.

FIG. 1 is a schematic diagram illustrating coupling between a light-emitting diode and a driving transistor according to an embodiment of the invention. FIG. 2 is a flowchart illustrating a control method of a light-emitting diode apparatus according to an embodiment of the invention. Referring to both FIG. 1 and FIG. 2, in the embodiment of FIG. 1 and FIG. 2, a driving transistor Td includes a first terminal t1, a second terminal t2, and a control terminal t3. An anode of a light-emitting diode D is coupled to the first terminal t1 of the driving transistor Td.

In the present embodiment, the control method may include the following steps. In step S210, a pre-reset voltage is applied to the control terminal t3 of the driving transistor Td of a light-emitting diode apparatus 100 in a pre-resetting stage to pre-reset the control terminal t3 of the driving transistor Td. Specifically, the pre-reset voltage may be provided, for example, by coupling to the control terminal of the driving transistor Td, and it is not specifically required that a voltage source should be directly connected. However, in some embodiments, the pre-reset voltage may also be directly provided. As long as the pre-reset voltage can be transmitted to the control terminal t3 of the driving transistor Td, any of direct transmission, indirect transmission, and transmission through coupling is possible, and the invention is not limited hereto. In step S220, the control terminal t3 of the driving transistor Td of the light-emitting diode apparatus is reset by using a reset voltage source in a first resetting stage. In step S230, the control terminal t3 of the driving transistor Td is compensated to a compensation voltage in a compensation stage. Moreover, in step S240, the driving transistor Td provides a driving current Id in a light emission stage to drive the light-emitting diode D of the light-emitting diode apparatus 100 to emit light.

In some embodiments, the control method further includes a second resetting stage. Through the second resetting stage, the voltage level of the first terminal t1 of the driving transistor Td can be reset to a target voltage after the compensation stage to increase the voltage difference between the first terminal t1 and the second terminal t2 of the driving transistor Td. In some embodiments, the start time point of the light emission stage may be right after the second resetting stage.

FIG. 3A to FIG. 3G are schematic diagrams illustrating control of a light-emitting diode apparatus according to an embodiment of the invention. Specifically, a light-emitting diode apparatus 300 may include a driving transistor Td, switches T1 to T6, and a charge storage device C, as shown in the embodiment of FIG. 3A to FIG. 3G. A second terminal of the driving transistor Td of the light-emitting diode apparatus 300 is coupled to a high voltage source OVDD. The high voltage source OVDD is configured to provide a high voltage level (e.g., 5V). A low voltage source OVSS may be configured to provide any low voltage levels lower than or equal to 0V. However, the invention is not limited hereto. A first terminal and a second terminal of the switch T1 are respectively coupled to a reference voltage source VREF and the charge storage device C. A second terminal of the switch T2 is configured to receive a data signal Vdata. The switch T3 and the switch T4 are connected in series between a control terminal and the second terminal of the driving transistor Td. The switch T5 is coupled between a common contact of the switch T3 and the switch T4 and a reset voltage source VINI. A first terminal and a second terminal of the switch T6 are respectively coupled to a first terminal of the driving transistor Td and an anode of a light-emitting diode D. The charge storage device C is coupled between the second terminal of the switch T2 and the control terminal of the driving transistor Td. The charge storage device C may be implemented, for example, as a capacitor.

Specifically, the driving transistor Td and the switches T1 to T6 may be respectively implemented, for example, as transistors. In the present embodiment, the driving transistor Td and the switches T1 to T6 are respectively p-type transistors. Moreover, in the present embodiment, the light-emitting diode D may be, for example, an organic light-emitting diode or an electroluminescent element of another type. The number of the light-emitting diode may be one or plural and is not specifically limited herein.

Figure 3A:
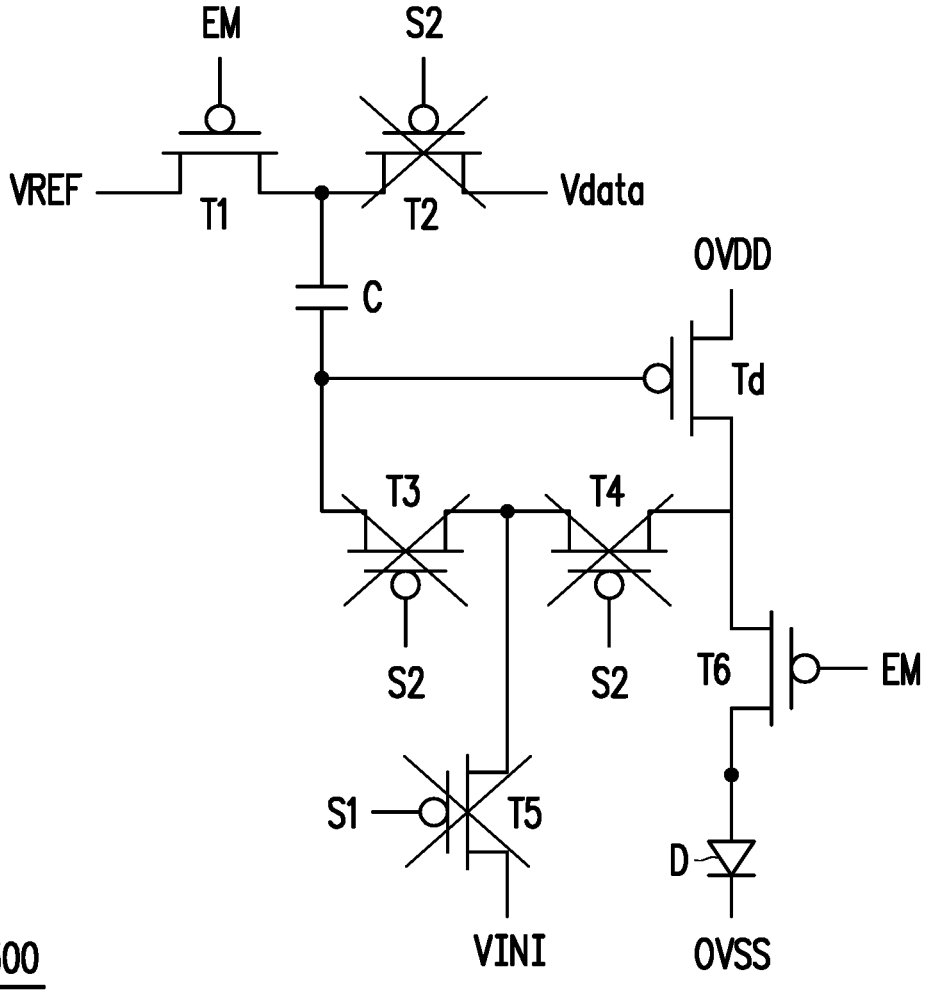
FIG. 3A to FIG. 3G are schematic diagrams illustrating control of a light-emitting diode apparatus according to an embodiment of the invention.
Figure 3B:
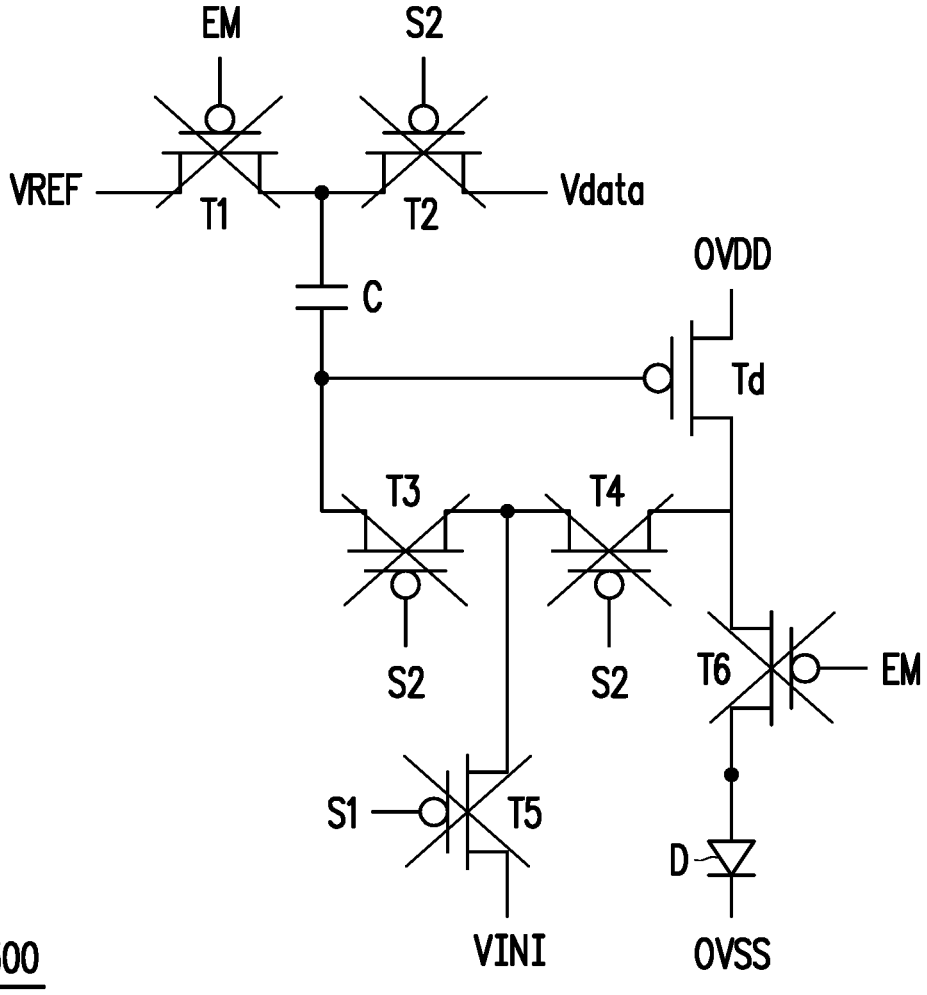
Figure 3C:
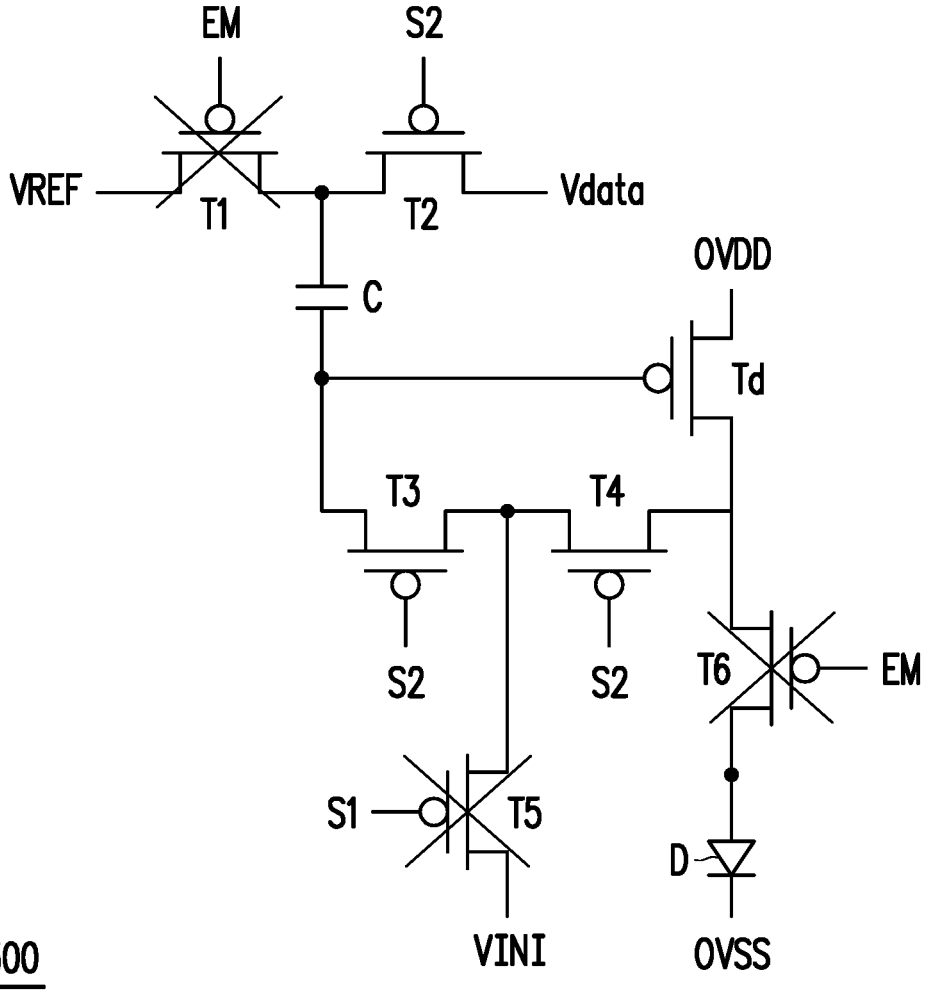
Figure 3D:
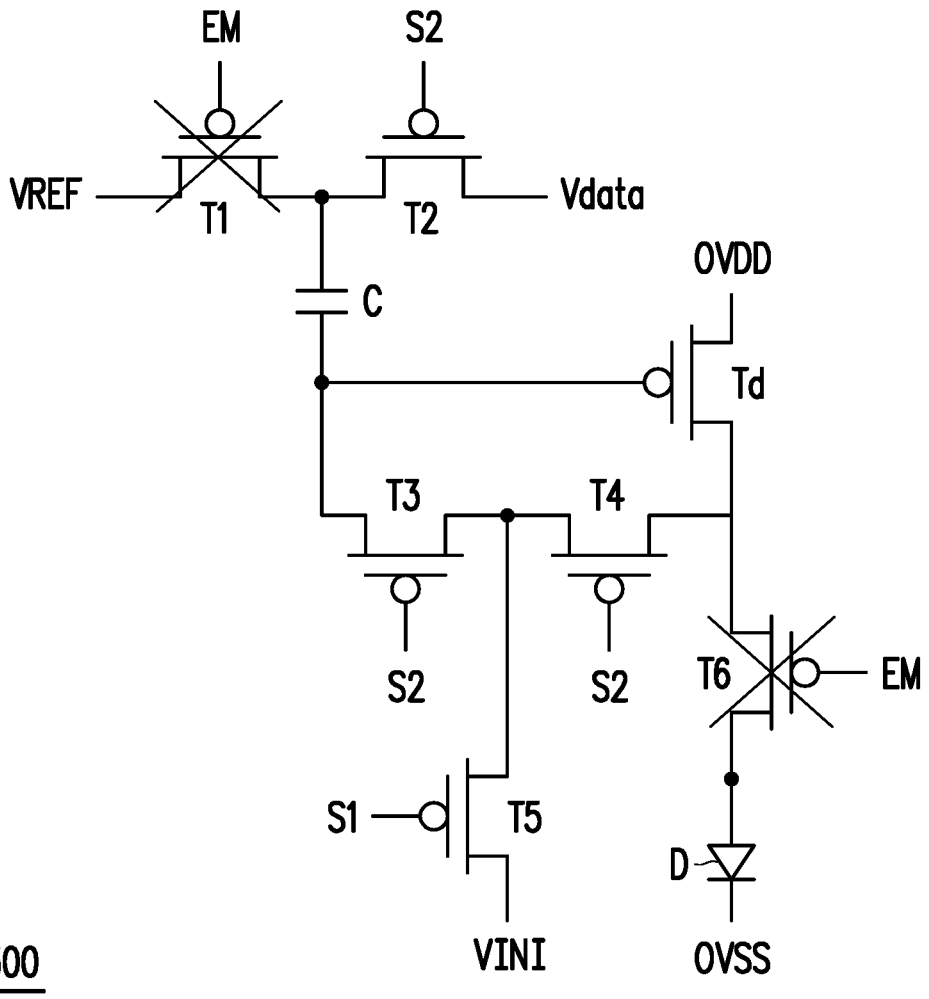
Figure 3E:
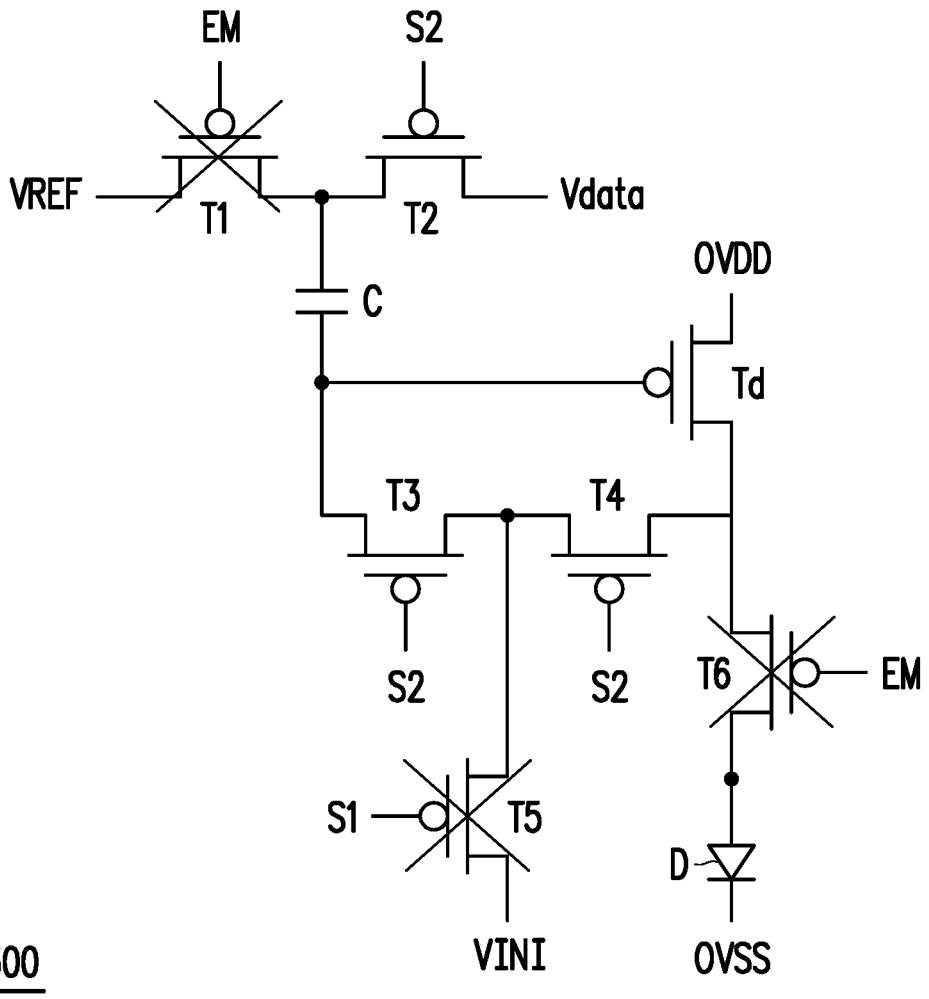
Figure 3F:
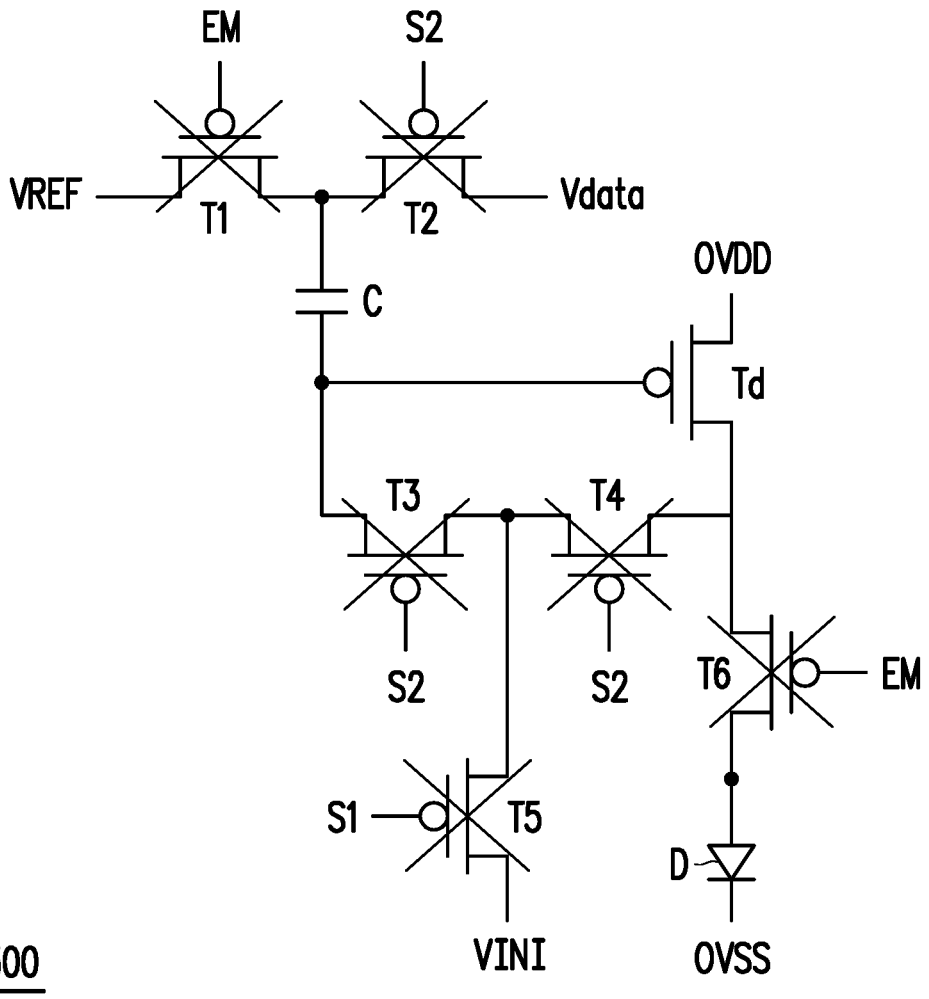
Figure 3G:
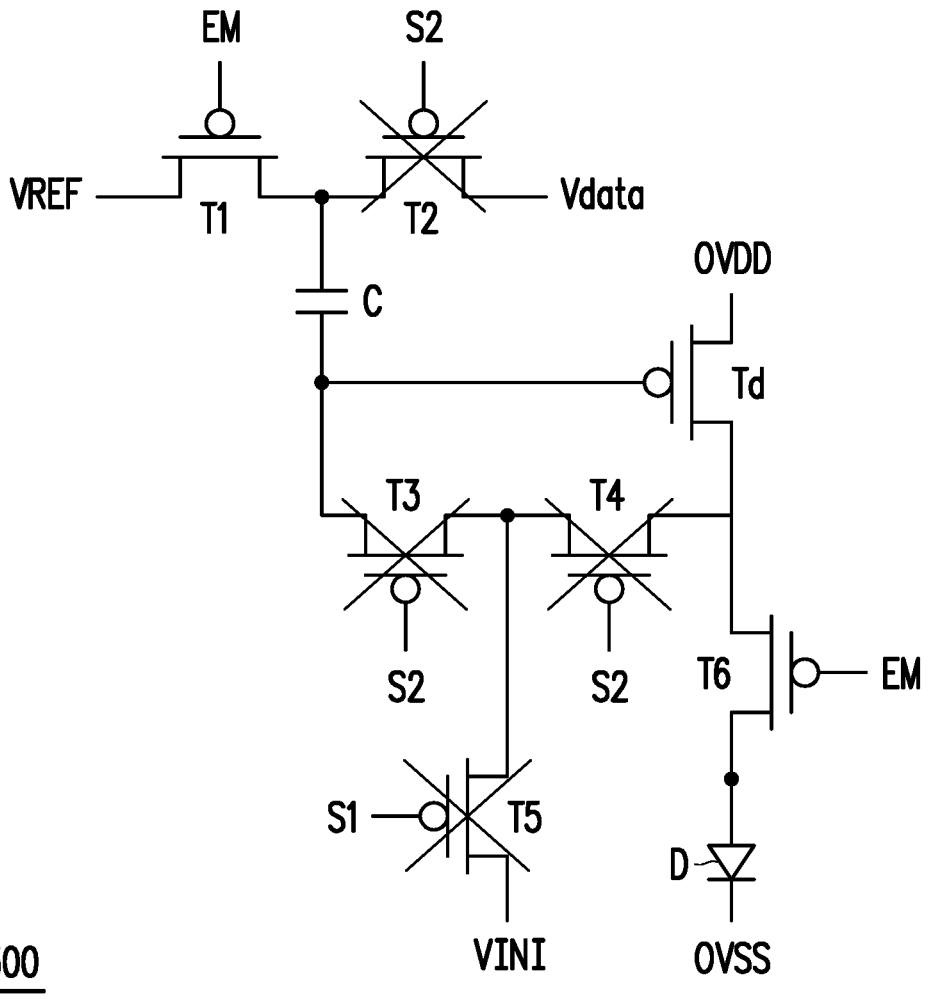
Figure 4:
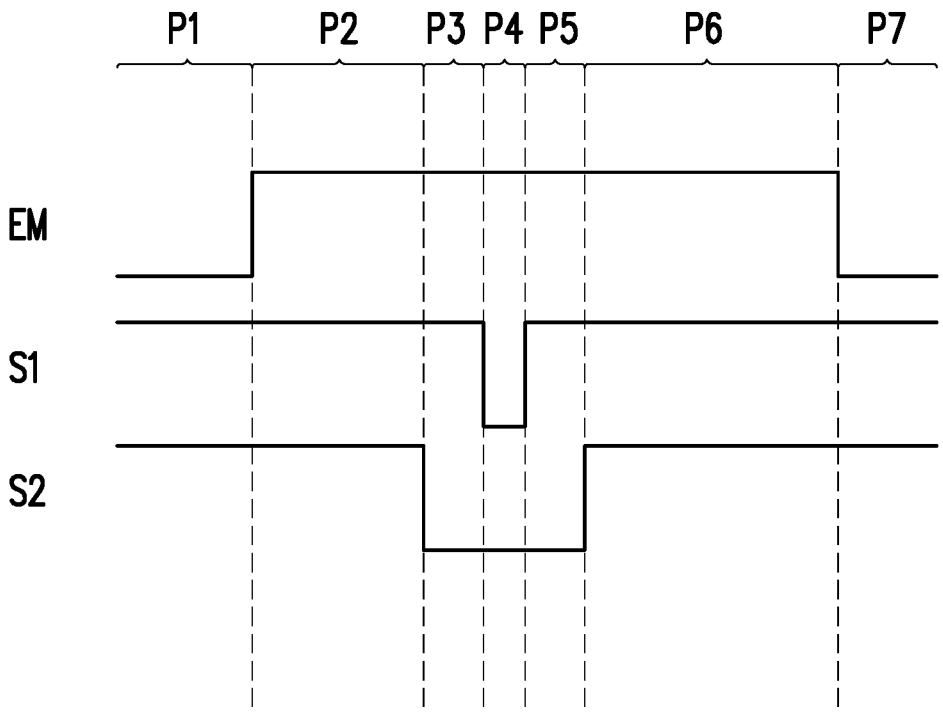
FIG. 4 is a control waveform schematic diagram corresponding to FIG. 3A to FIG. 3G.

FIG. 4 is a control waveform schematic diagram corresponding to FIG. 3A to FIG. 3G. As shown in FIG. 4, the control waveform schematic diagram may be divided into seven stages including a light emission stage P1, a light emission stop stage P2, a pre-resetting stage P3, a first resetting stage P4, a compensation stage P5, a light emission stop stage P6, and a light emission stage P7. For ease of illustration, in FIG. 3A to FIG. 3G, the open switches are indicated by X marks, and the closed switches are not indicated by X marks.

Referring to both FIG. 3A and FIG. 4, in the light emission stage P1, the voltage level of a light emission control signal EM drops to the logic low level, and the voltage levels of control signals S1, S2 are maintained at the logic high level, which causes the switches T1, T6 to be in the on state. The voltage (e.g., 1.5V) provided by the reference voltage source VREF is coupled to the control terminal of the driving transistor Td through the switch T1 and the charge storage device C to turn on the driving transistor Td and thereby provide a driving current to the light-emitting diode D and drive the light-emitting diode D to emit light.

Referring to both FIG. 3B and FIG. 4, in the light emission stop stage P2, the voltage levels of the light emission control signal EM and the control signals S1, S2 are the logic high level, which causes the switches T1 to T6 to be in the off state. Therefore, in the light emission stop stage P2, the light-emitting diode cannot receive the driving current to emit light. At this time, the voltage of the control terminal of the driving transistor Td is identical to that in the light emission stage P1.

Referring to both FIG. 3C and FIG. 4, in the pre-resetting stage P3, the voltage level of the control signal S2 drops to the logic low level, and the voltage levels of the light emission control signal EM and the control signal S1 are maintained at the logic high level, which turns on the switches T2 to T4 and turns off the switches T1, T5 to T6. In the pre-resetting stage P3, the data signal Vdata may provide a pre-reset voltage (e.g., 0.5V, but the invention is not limited hereto) having a voltage level lower than the voltage level (e.g., 1.5V) of the reference voltage source VREF to pull down the voltage of the control terminal of the driving transistor Td and thereby increase the voltage difference between the control terminal and the second terminal of the driving transistor Td, which causes the voltage of the control terminal of the driving transistor Td to be closer to the voltage required for turning on the channel of the driving transistor Td or slightly turns on the channel of the driving transistor Td in advance. In the present embodiment, the pre-reset voltage is provided by coupling the pre-reset voltage to the control terminal of the driving transistor Td through the switch T2 and the charge storage device C. In some embodiments, a voltage source may also be additionally disposed to directly provide the pre-reset voltage.

Referring to both FIG. 3D and FIG. 4, in the first resetting stage P4, the voltage level of the control signal S1 drops to the logic low level, the voltage level of the light emission control signal EM is maintained at the logic high level, and the voltage level of the control signal S2 is maintained at the logic low level, which turns on the switches T2 to T5 and turns off the switches T1 and T6. Specifically, turning on of the switch T5 enables the reset voltage (which may be set, for example, at −1.5V but is not limited hereto and may also be set, for example, at a voltage lower than the voltage of the control terminal of the driving transistor Td in the pre-resetting stage P3) from the reset voltage source VINI to reset the control terminal of the driving transistor Td and thereby pull down the voltage of the control terminal of the driving transistor Td. Moreover, in the first resetting stage P4, the data signal Vdata may provide a data voltage (e.g., 1V or 2V, but the invention is not limited hereto) instead.

Referring to both FIG. 3E and FIG. 4, in the compensation stage P5, the voltage level of the control signal S1 is raised to the logic high level, the voltage level of the light emission control signal EM is maintained at the logic high level, and the voltage level of the control signal S2 is maintained at the logic low level, which turns on the switches T2 to T4 and turns off the switches T1, T5 to T6. In the compensation stage P5, the voltage level of the control terminal of the driving transistor Td may be compensated to the compensation voltage, namely compensated to a difference value between the voltage level of the high voltage source OVDD and a threshold voltage of the driving transistor Td. Accordingly, the voltage levels of the control terminal and the first terminal of the driving transistor Td can be corrected through the circuit operations in the pre-resetting stage P3, the first resetting stage P4, and the compensation stage P5 to improve the component property errors of the driving transistor Td generated due to differences in the manufacturing process and mitigate the effect arising during transfer between different image data. Moreover, by pulling down the voltage of the control terminal of the driving transistor Td in the pre-resetting stage P3 and the first resetting stage P4, the coupling effect in the circuit can be effectively offset, and motion blur of the light-emitting diode apparatus 300 can be reduced.

Referring to both FIG. 3F and FIG. 4, in the light emission stop stage P6, the voltage level of the control signal S2 is raised to the logic high level, and the voltage levels of the light emission control signal EM and the control signal S1 are maintained at the logic high level, which causes the driving transistor Td and the switches T1 to T6 to all be in the off state. Specifically, the charge storage device C stores compensation information and voltage information (at this time, the voltage level of the control terminal of the driving transistor Td is still equal to the difference value between the voltage level of the high voltage source OVDD and the threshold voltage of the driving transistor Td) of the data signal Vdata.

Next, referring to both FIG. 3G and FIG. 4, in the light emission stage P7, the voltage level of the light emission control signal EM drops to the logic low level, and the voltage levels of the control signals S1, S2 are maintained at the logic high level, which causes the switches T1, T6 to be in the on state. Accordingly, due to voltage coupling of the charge storage device C, the voltage level of the control terminal of the driving transistor Td can provide the corresponding driving current to drive the light-emitting diode D to emit light.

In some embodiments, a second resetting stage may be added to the light emission stop stage P6 and the light emission stage P7 of the light-emitting diode apparatus 300 to reset the voltage level of the second terminal of the switch T6 and increase the voltage difference between the first terminal and the second terminal of the switch T6.

Figure 5:
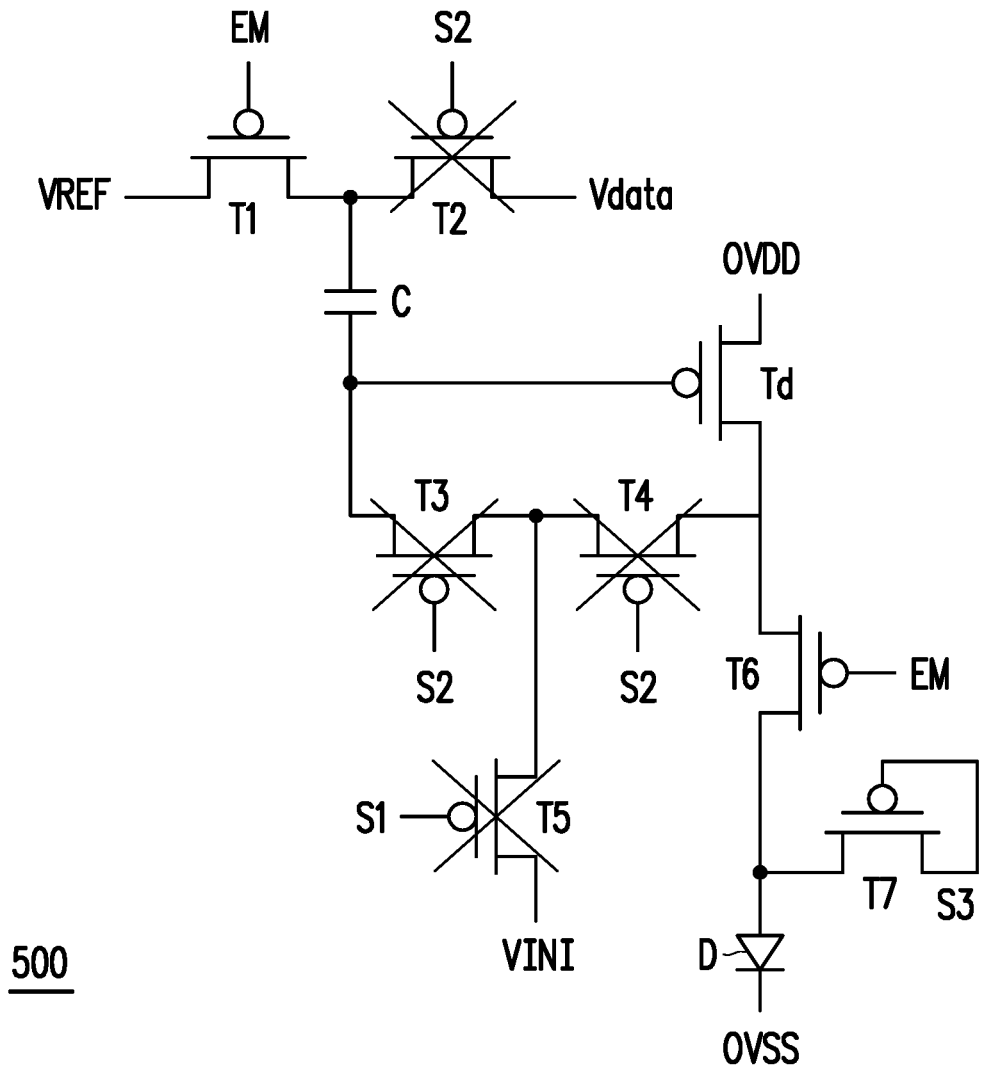
FIG. 5 is a schematic diagram illustrating a light-emitting diode apparatus according to another embodiment of the invention.
Figure 6:
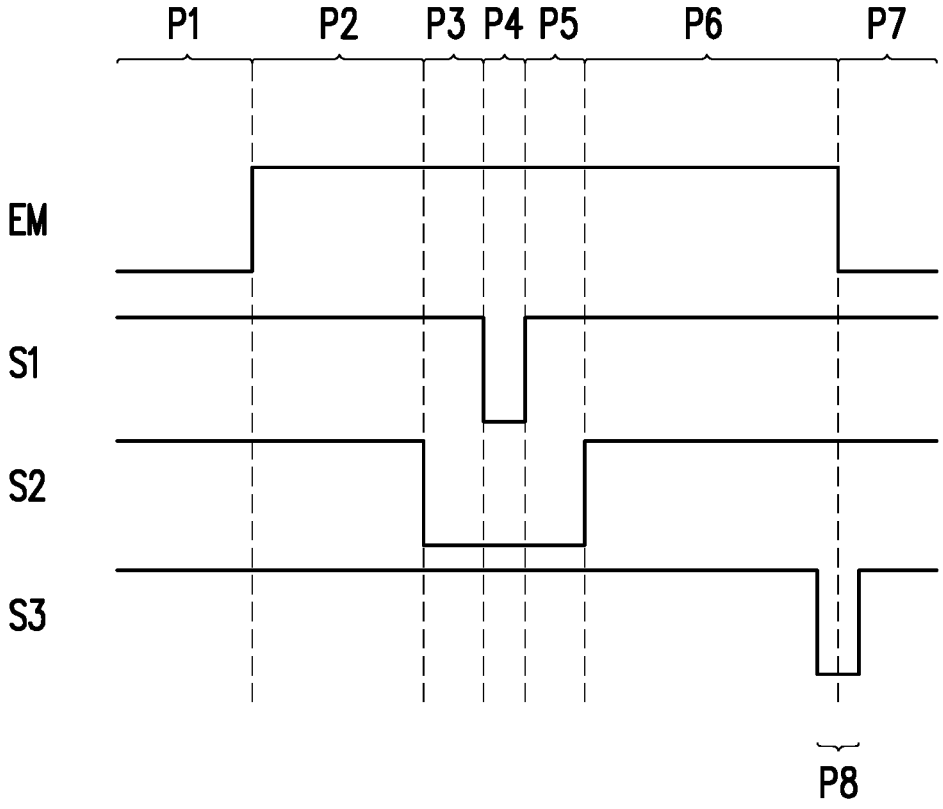
FIG. 6 is a control waveform schematic diagram according to FIG. 5.

FIG. 5 is a schematic diagram illustrating a light-emitting diode apparatus according to another embodiment of the invention. FIG. 6 is a control waveform schematic diagram according to FIG. 5. Referring to FIG. 5, the difference from FIG. 3A to FIG. 3G lies in that a light-emitting diode apparatus 500 of FIG. 5 additionally includes a switch T7. A second terminal of the switch T7 is coupled to the anode of the light-emitting diode. A first terminal and a control terminal of the switch T7 collectively receive a reset signal S3. Referring to FIG. 6, the difference from FIG. 4 lies in that FIG. 6 additionally includes a second resetting stage P8.

The start time point of the light emission stage P7 may be, for example, between the start time point and the end time point of the second resetting stage P8. In some embodiments, the start time point of the light emission stage P7 may also be right after the end time point of the second resetting stage P8.

Referring to both FIG. 5 and FIG. 6, in the embodiment of FIG. 5 and FIG. 6, in the second resetting stage P8, the voltage level of the reset signal S3 is pulled down to the logic low level (which may be set, for example, at 1V, but the invention is not limited hereto), and the switch T7 is turned on. The voltage level of the second terminal of the switch T6 is also reset to the target voltage (e.g., 1V) according to the voltage level of the reset signal S3. Therefore, in the second resetting stage P8, the voltage difference between the second terminal and the first terminal of the driving transistor Td can be effectively increased to increase the driving current Id provided to the light-emitting diode D by the driving transistor Td in the light emission stage P7 and thereby reduce motion blur of the light-emitting diode apparatus 300.

In some embodiments, the reset signal S3 may be generated, for example, by delaying the control signal S1. In other words, through signal delay, a time delay between the second resetting stage P8 and the first resetting stage P4 is present between the generated reset signal S3 and the control signal S1. In some embodiments, the signal delay may be realized by coupling a delay circuit to the second terminal of the switch T6 or coupling a delay circuit to the first terminal of the switch T7.

Figure 7:
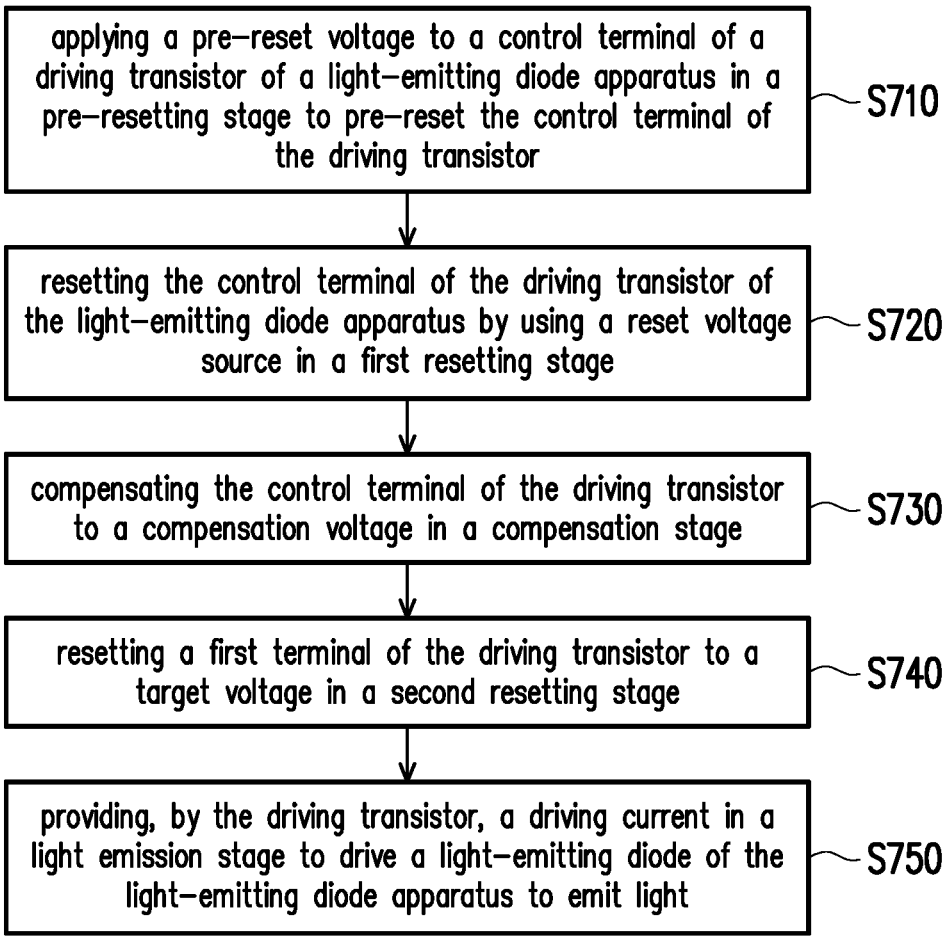
FIG. 7 is a flowchart illustrating a control method of a light-emitting diode apparatus according to an embodiment of the invention.

Referring to FIG. 7, FIG. 7 is a flowchart illustrating a control method of a light-emitting diode apparatus according to an embodiment of the invention. According to the embodiment of FIG. 5 and FIG. 6, the control method of the light-emitting diode apparatus may include the following steps. First, in step S710, a pre-reset voltage is applied to a control terminal of a driving transistor of the light-emitting diode apparatus in a pre-resetting stage to pre-reset the control terminal of the driving transistor. Similarly, the pre-reset voltage of the present embodiment may also be provided, for example, by coupling a data signal to the control terminal of the driving transistor through at least one capacitor, and it is not required to additionally dispose a voltage source. In some embodiments, a voltage source may also be additionally disposed to directly provide the pre-reset voltage. In step S720, the control terminal of the driving transistor of the light-emitting diode apparatus is reset by using a reset voltage source in a first resetting stage. In step S730, the control terminal of the driving transistor is compensated to a compensation voltage in a compensation stage. In step S740, a first terminal of the driving transistor is reset to a target voltage in a second resetting stage. In step S750, the driving transistor provides a driving current in a light emission stage to drive a light-emitting diode of the light-emitting diode apparatus to emit light. Further implementations of step S710 to S750 above are already detailed in the foregoing embodiments and shall not be repeated described in detail here.

In summary of the above, in the light-emitting diode apparatus of the invention, the control terminal of the driving transistor is pre-reset in the pre-resetting stage, the control terminal of the driving transistor is reset by using the reset voltage source in the first resetting stage, and the control terminal of the driving transistor is compensated to the compensation voltage in the compensation stage. Accordingly, by pulling down the voltage of the control terminal of the driving transistor in the pre-resetting stage and the first resetting stage, the voltage difference between the source and the gate of the driving transistor can be effectively increased to offset the coupling effect in the circuit, and motion blur of the light-emitting diode apparatus can be reduced. In some embodiments, the voltage level of the first terminal of the driving transistor may be further pulled down in the second resetting stage to increase the voltage difference between the second terminal and the first terminal of the driving transistor.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. A control method of a light-emitting diode apparatus, comprising:

applying a pre-reset voltage to a control terminal of a driving transistor of the light-emitting diode apparatus in a pre-resetting stage to pre-reset the control terminal of the driving transistor, wherein the driving transistor has a first terminal and a second terminal, the pre-reset voltage increases a voltage difference between the control terminal and the first terminal of the driving transistor;

resetting the control terminal of the driving transistor of the light-emitting diode apparatus by using a reset voltage source in a first resetting stage;

compensating the control terminal of the driving transistor to a compensation voltage in a compensation stage; and providing, by the driving transistor, a driving current in a light emission stage to drive a light-emitting diode of the light-emitting diode apparatus to emit light, wherein the pre-reset voltage is different from a voltage provided from the reset voltage source, wherein the first terminal of the driving transistor is coupled to a high voltage source, and the light-emitting diode apparatus further comprises a first switch, a second switch, a third switch, a fourth switch, a fifth switch, a sixth switch, and a charge storage device, wherein a first terminal and a second terminal of the first switch are respectively coupled to a reference voltage source and a first terminal of the second switch, a second terminal of the second switch is configured to receive a data signal, the charge storage device is coupled between the first terminal of the second switch and the control terminal of the driving transistor, the third switch and the fourth switch are connected in series between the control terminal and the second terminal of the driving transistor, the fifth switch is coupled between a common contact of the third switch and the fourth switch and the reset voltage source, a first terminal and a second terminal of the sixth switch are respectively coupled to the second terminal of the driving transistor and an anode of the light-emitting diode, a cathode of the light-emitting diode is coupled to a low voltage source, on/off states of the first switch and the sixth switch are controlled by a light emission control signal, an on/off state of the fifth switch is controlled by a first control signal, on/off states of the second switch to the fourth switch are controlled by a second control signal, and the control method of the light-emitting diode apparatus comprises:

in the pre-resetting stage, turning on the switches controlled by the second control signal, and turning off the switches controlled by the light emission control signal and the first control signal;

in the first resetting stage, turning on the switches controlled by the first control signal and the second control signal, and turning off the switches controlled by the light emission control signal;

in the compensation stage, turning on the switches controlled by the second control signal, and turning off the switches controlled by the light emission control signal and the first control signal; and in the light emission stage, turning on the switches controlled by the light emission control signal, and turning off the switches controlled by the first control signal and the second control signal.

2. The control method of the light-emitting diode apparatus according to claim 1, wherein the pre-reset voltage is a voltage of a data signal coupled to the control terminal of the driving transistor through at least one capacitor.

3. The control method of the light-emitting diode apparatus according to claim 1, further comprising:

resetting the second terminal of the driving transistor to a target voltage in a second resetting stage to increase a voltage difference between the first terminal and a second terminal of the driving transistor, wherein the second terminal of the driving transistor is coupled to the light-emitting diode.

4. The control method of the light-emitting diode apparatus according to claim 3, wherein a start time point of the light emission stage is between a start time point and an end time point of the second resetting stage.

5. The control method of the light-emitting diode apparatus according to claim 1, comprising:

resetting the second terminal of the sixth switch to a target voltage in a second resetting stage to increase a voltage difference between the first terminal and the second terminal of the driving transistor.

6. The control method of the light-emitting diode apparatus according to claim 5, wherein a start time point of the light emission stage is between a start time point and an end time point of the second resetting stage.

7. The control method of the light-emitting diode apparatus according to claim 6, comprising:

delaying the first control signal to generate a reset signal in the second resetting stage to reset the second terminal of the sixth switch to the target voltage.

8. The control method of the light-emitting diode apparatus according to claim 1, wherein the first switch to the sixth switch respectively comprise a transistor.

9. The control method of the light-emitting diode apparatus according to claim 1, wherein the compensation voltage is a difference value between a voltage level of a high voltage source and a threshold voltage of the driving transistor.

10. A light-emitting diode apparatus comprising:

a driving transistor, having a first terminal, a second terminal and a control terminal;

a light-emitting diode, wherein an anode and a cathode of the light-emitting diode are respectively coupled to the second terminal of the driving transistor and a low voltage source, the first terminal of the driving transistor is coupled to a high voltage source, the control terminal of the driving transistor receives a pre-reset voltage in a pre-resetting stage to be pre-reset, the control terminal of the driving transistor receives a reset voltage in a first resetting stage to be reset, the control terminal of the driving transistor is compensated to a compensation voltage in a compensation stage, and the driving transistor provides a driving current in a light emission stage to drive the light-emitting diode to emit light, wherein the pre-reset voltage increases a voltage difference between the control terminal and the first terminal of the driving transistor, a first switch;

a second switch, wherein a first terminal and a second terminal of the first switch are respectively coupled to a reference voltage source and a first terminal of the second switch, and a second terminal of the second switch is configured to receive a data signal;

a third switch;

a fourth switch, wherein the third switch and the fourth switch are connected in series between the control terminal and the second terminal of the driving transistor;

a fifth switch coupled between a common contact of the third switch and the fourth switch and a reset voltage source;

a sixth switch, wherein a first terminal and a second terminal of the sixth switch are respectively coupled to the second terminal of the driving transistor and the anode of the light-emitting diode; and a charge storage device coupled between the first terminal of the second switch and the control terminal of the driving transistor, wherein on/off states of the first switch and the sixth switch are controlled by a light emission control signal, an on/off state of the fifth switch is controlled by a first control signal, on/off states of the second switch to the fourth switch are controlled by a second control signal, wherein the switches controlled by the second control signal are turned on and the switches controlled by the light emission control signal and the first control signal are turned off in the pre-resetting stage, the switches controlled by the first control signal and the second control signal are turned on and the switches controlled by the light emission control signal are turned off in the first resetting stage, the switches controlled by the second control signal are turned on and the switches controlled by the light emission control signal and the first control signal are turned off in the compensation stage, and the switches controlled by the light emission control signal are turned on and the switches controlled by the first control signal and the second control signal are turned off in the light emission stage, wherein the pre-reset voltage is different from a voltage provided from the reset voltage source.

11. The light-emitting diode apparatus according to claim 10, wherein the pre-reset voltage is a voltage of a data signal coupled to the control terminal of the driving transistor through at least one capacitor.

12. The light-emitting diode apparatus according to claim 10, wherein the second terminal of the driving transistor is reset to a target voltage in a second resetting stage to increase a voltage difference between the first terminal and the second terminal of the driving transistor.

13. The light-emitting diode apparatus according to claim 12, wherein a start time point of the light emission stage is between a start time point and an end time point of the second resetting stage.

14. The light-emitting diode apparatus according to claim 10, wherein the second terminal of the sixth switch is reset to a target voltage in a second resetting stage to increase a voltage difference between the first terminal and the second terminal of the driving transistor.

15. The light-emitting diode apparatus according to claim 14, wherein a start time point of the light emission stage is between a start time point and an end time point of the second resetting stage.

16. The light-emitting diode apparatus according to claim 15, comprising:

a delay circuit, coupled to the second terminal of the sixth switch, delaying the first control signal to generate a reset signal in the second resetting stage to reset the second terminal of the sixth switch to the target voltage.

17. The light-emitting diode apparatus according to claim 10, wherein the first switch to the sixth switch respectively comprise a transistor.

18. The light-emitting diode apparatus according to claim 10, wherein the compensation voltage is a difference value between a voltage level of the high voltage source and a threshold voltage of the driving transistor.

* * * * *